US011058199B2

(12) United States Patent
Chelle et al.

(10) Patent No.: US 11,058,199 B2
(45) Date of Patent: Jul. 13, 2021

(54) HAIR STYLING APPLIANCE EQUIPPED WITH AN ELASTIC MECHANISM FOR GUIDING A WICK

(71) Applicant: SEB S.A., Ecully (FR)

(72) Inventors: Jacky Chelle, Auberives-sur-Vareze (FR); Bertrand Couet, Loire-sur-Rhone (FR); Franck Da Palma, Saint Etienne (FR)

(73) Assignee: SEB S.A., Ecully (FR)

( * ) Notice: Subject to any disclaimer, the term of this patent is extended or adjusted under 35 U.S.C. 154(b) by 298 days.

(21) Appl. No.: 15/848,813

(22) Filed: Dec. 20, 2017

(65) Prior Publication Data

US 2018/0168309 A1 Jun. 21, 2018

(30) Foreign Application Priority Data

Dec. 21, 2016 (FR) ..... 1663042

(51) Int. Cl.

| | |
|---|---|
| ***A45D 6/06*** | (2006.01) |
| ***A45D 1/04*** | (2006.01) |
| ***A45D 2/36*** | (2006.01) |
| ***A45D 1/16*** | (2006.01) |
| *A45D 1/00* | (2006.01) |

(52) U.S. Cl.

CPC ..... *A45D 1/04* (2013.01); *A45D 1/16* (2013.01); *A45D 2/36* (2013.01); *A45D 2001/008* (2013.01)

(58) Field of Classification Search

CPC ... A45D 1/00; A45D 1/04; A45D 1/06; A45D 1/08; A45D 1/16; A45D 2/36; A45D 2/00

See application file for complete search history.

(56) References Cited

U.S. PATENT DOCUMENTS 3,835,292 A * 9/1974 Walter ..... A45D 1/04 219/222

3,937,232 A 2/1976 Tomaro (Continued)

FOREIGN PATENT DOCUMENTS

DE 2634972 A1 * 2/1978
DE 0054188 * 11/1981

(Continued)

OTHER PUBLICATIONS

Search Report as issued in French Patent Application No. 1663042, dated Jun. 16, 2017.

*Primary Examiner* — Rachel R Steitz

(74) *Attorney, Agent, or Firm* — Pillsbury Winthrop Shaw Pittman LLP

(57) ABSTRACT

A hair styling appliance for curling hair includes a mandrel, a liquid reservoir, a heating element integrated in the mandrel, a wick communicating with the reservoir such that it is soaked with liquid, the wick extending between a proximal end intended to come into contact with the heating element and a distal end supplied with liquid from the reservoir, and a guide system for guiding the wick that is configured to permit it to move from a passive position to an active position in which the wick is in contact with the heating element in order to create steam, wherein the guide system includes an elastic guiding mechanism in contact with the periphery of the wick at the proximal end.

19 Claims, 4 Drawing Sheets

(56) References Cited

U.S. PATENT DOCUMENTS

| | | | | | |
|---|---|---|---|---|---|
| 4,004,596 | A | * | 1/1977 | Hyland | A45D 1/04 132/232 |
| 4,009,367 | A | * | 2/1977 | Rizzuto | A45D 1/04 219/222 |
| 4,192,328 | A | * | 3/1980 | Barradas | A45D 1/04 132/232 |
| 4,365,140 | A | * | 12/1982 | Bast | A45D 1/04 132/232 |
| 6,029,677 | A | * | 2/2000 | Nanba | A45D 1/04 132/225 |

FOREIGN PATENT DOCUMENTS

| | | | |
|---|---|---|---|
| EP | 1 894 488 | A1 | 3/2008 |
| WO | WO 01/67915 | A2 | 9/2001 |

* cited by examiner

HAIR STYLING APPLIANCE EQUIPPED WITH AN ELASTIC MECHANISM FOR GUIDING A WICK

CROSS-REFERENCE TO RELATED APPLICATIONS

This application claims priority to French Patent Application No. 1663042, filed Dec. 21, 2016, the entire content of which is incorporated herein by reference in its entirety.

FIELD

This invention relates to the field of "curler"-type hair styling appliances for curling hair, and more specifically to such hair styling appliances equipped with a steam-production system comprising a liquid reservoir, a wick soaked with the liquid and a heating element with which the wick comes into contact.

In addition, such a hair styling appliance comprises a mandrel and a tile, these elements being articulated to form a clamp so as to make it possible to grip a strand of hair in order to roll it around the mandrel and thus to curl it.

BACKGROUND

From patent applications WO0167915A2 and EP1894488A1, it is known to use a wick to move liquid contained in the reservoir of a hair curling appliance to a heating element in order to produce steam. More precisely, the wick, in contact with the liquid contained in the reservoir, will become soaked with the liquid by capillarity, thus permitting the liquid to be transferred from the reservoir to the heating element. This solution is known to permit the production of steam, which has the effect of improving and facilitating the styling, hold and appearance of the hair, and in particular of the curls that can be formed using this type of appliance.

In particular, such an appliance comprises a reservoir mounted on the end of the curling appliance and which is separated from a heating element by the wick. The wick and the reservoir are mounted so that they can move with respect to the heating element in order to permit the user to choose whether to produce steam during use of the appliance. When the user wishes to produce steam, he or she applies pressure on the reservoir, which has the effect of moving the latter and the wick toward the heating element. The wick is then in contact with the heating element, which has the effect of vaporizing the liquid it contains in its end, and consequently producing the steam which is then released on the hair.

Such appliances generally provide satisfaction to their users but they also present certain drawbacks, notably from the point of view of durability and reliability. In fact, as the wick is moved, when the user presses on the reservoir, the wick comes into contact with the heating element. During this contact, the end of the wick, under the effect of the force applied by the user, but also of the heat, will become compacted, that is, deform in places. More precisely, the overall length of the wick will decrease, while its diameter will increase in places. As the appliance is used, this results in poorer contact between the wick and the heating elements, and consequently poorer steam production. The effectiveness of the curling device is then diminished, to the point that it may even become impossible to produce steam if the wick is too compacted, too damaged, and no longer comes into contact with the heating element. Consequently, the result is a lack of reliability and a limited durability of the hair styling appliance.

Another drawback of these known appliances concerns their maintenance. In fact, because of the presence of heated liquid, which is generally water, scale tends to form in the wick. The user must then disassemble the latter in order to descale it, for example by dipping it in an acidic solution (vinegar, for example). But given the flexibility of the wick, the operation of disassembling and reassembling the wick proves to be particularly fastidious and delicate, all the more so if the wick is worn, that is, if it has previously been compacted, since the latter will then have been deformed, as described previously. This results in serious problems for the user, particularly when reassembling the wick after descaling, and may even make reassembly impossible if the wick is too deformed.

SUMMARY

An aspect of his invention is to remedy the aforementioned drawbacks.

An aspect of the invention is to propose a hair styling appliance for curling hair that is particularly reliable and robust, in particular by avoiding wick compaction as the curling appliance is used.

Another aspect of the invention is to propose a hair styling appliance for curling hair that offers the user easy maintenance.

Another aspect of the invention is to propose a hair styling appliance for curling hair whose construction is particularly simple, economical and reliable.

Another aspect of the invention is to propose a hair styling appliance for curling hair that produces steam quickly and continuously when the user wishes.

Another aspect of the invention is to propose a hair styling appliance that is particularly ergonomic to use.

Another aspect of the invention is to propose a hair styling appliance that is particularly simple and intuitive to use.

These aspects are achieved through a hair styling appliance for curling hair comprising a mandrel, a liquid reservoir, a heating element integrated in the mandrel, a wick communicating with the reservoir such that it is soaked with liquid, the wick extending between a proximal end intended to come into contact with the heating element and a distal end supplied with liquid from the reservoir, and a guide system configured to guide the wick that is configured to permit it to move from a passive position to an active position in which the wick is in contact with the heating element in order to create steam, wherein the guide system comprises an elastic guiding mechanism in contact with the periphery of the wick at the proximal end.

More precisely, the elastic guiding mechanism is designed to be able to deform elastically along an axial deformation, the axial deformation roughly corresponding to the axis of the wick, that is, the direction along which the latter extends. Preferentially, in an embodiment, the direction corresponds to the axis along which the wick moves between its passive position and its active position. Thus, the elastic guiding mechanism ensures that the peripheral surface of the wick is maintained in a direction perpendicular to the wick. In other words, the proximal end of the wick, which is intended to come regularly into contact with the heating element to produce steam, is remarkably maintained and guided along a direction roughly perpendicular to the direction of movement of the wick, which permits limiting, or even eliminating, the phenomenon of wick compaction. On the other hand, given the elasticity of the mechanism for guiding along the axial direction, the wick remains free to move axially, and to be compressed axially, which permits in particular optimizing its contact with the heating element. In addition, the active position of the appliance, that is, the steam-producing position, is not constrained by the length of the wick.

Preferentially, in an embodiment, an electrical system permits activating the heating element, which comprises beneficially a vaporizing plate against which the wick comes into contact in the active position. According to the hair styling appliance covered by the invention, the latter beneficially comprises a temperature control unit for the heating element. In addition, a detection system is configured to trigger the control unit when the wick shifts into active position.

Preferentially, in an embodiment, the elastic guiding mechanism is permeable to air in order to permit venting of the reservoir, in order to offset the negative pressure connected to the draining of the liquid from the reservoir through the wick.

Beneficially, the elastic guiding mechanism comprises a helical spring, and the wick is positioned inside the spring, which permits proposing a simple, robust and economical assembly.

Beneficially, the diameter of the spring is between 2 mm and 8 mm, and preferentially in an embodiment between 4 mm and 6 mm. The length of the spring at rest is between 15 mm and 45 mm, and preferentially in an embodiment between 25 mm and 35 mm.

In addition, the guide system comprises a wick carrier inside which the helical spring is positioned. Such an arrangement permits having a wick-guiding mechanism that is particularly precise, robust and reliable, while permitting the passage of air, notably between the coils of the spring, as will be described below.

Beneficially, the wick carrier comprises a channel for carrying air toward the reservoir, in order to avoid negative pressure in the reservoir as the liquid is emptied.

Preferentially, in an embodiment, the elastic guiding mechanism extends between the proximal and distal ends of the wick, in other words, extends along the full length of the wick. In addition, the elastic guiding mechanism comprises a stop able to come into contact with the distal end, which permits beneficially locking the wick's motion according to at least one direction of axial movement.

According to a particular embodiment, which may constitute an invention as such, the hair styling device for curling hair comprises a mandrel, a liquid reservoir, a heating element integrated in the mandrel, a wick communicating with the reservoir such that it becomes soaked with liquid and wick-guide system configured to permit its movement from a passive position to an active position in which the wick is in contact with the heating element in order to create steam, the wick comprising a plurality of strands in contact with each other, the strands extending longitudinally. In other words, the wick is composed of several separate threads or filaments, and the gathering, juxtaposition, assembly of the latter make it possible to form the wick, for example, in the manner of a cable. The wick thus does not consist of a continuous material, but rather of an assembly of materials. Therefore, the physical properties of each of the strands are different from the physical properties of the wick formed by the assembly of these strands. Beneficially, the wick consists of different strands juxtaposed in parallel with each other so as to form a cylinder comprising several strands.

Still according to this embodiment, each strand is preferentially a strand of fiberglass. This embodiment permits proposing a wick consisting of a particularly heat-resistant material, which will give the wick, and consequently the hair styling appliance, great durability and great reliability.

This specific construction makes it possible in particular, depending on the number of strands in the wick, to be able to vary the flow of liquid transferred from the reservoir to the heating element. Beneficially, the more strands there are, the lower the flow, because there is very little free space in the wick. Conversely, the fewer strands there are, the higher the flow. Preferentially, in an embodiment, the wick contains 14 strands.

In a particularly beneficial manner, the length of each strand is between 30 mm and 90 mm and preferentially in an embodiment between 50 mm and 70 mm, each of the strands being folded on itself so as to divide its length in two. Beneficially, the length of each of the strands is about 60 mm, which permits forming a wick with a length of 30 mm when the strands are folded on themselves. Preferentially, in an embodiment, the bend of the strands forms the distal end of the wick, while the free end of the strands forms the proximal end.

Alternatively, in a manner known as such, and without departing from the context of the invention, the wick is made of a continuous and uniform material, sufficiently porous to permit movement of the liquid by capillarity.

Preferentially, in an embodiment, the wick is integral with the reservoir, the guide system being configured to move the reservoir and the wick from the passive position to the active position. Preferably, in an embodiment, the reservoir is positioned at the distal end of the mandrel, that is, the end farthest from the gripping area of the appliance. Thus, when the user applies pressure on the reservoir, this has the effect of moving the wick to the active position.

Beneficially, in an embodiment, the hair styling appliance comprises a locking/unlocking system configured to ensure that the reservoir and wick are kept in the active position, which prevents the user from having to keep the reservoir and the wick in the active position during the entire curling operation. Because of the possible axial deformation of the elastic guiding mechanism and of the wick, this beneficial embodiment makes it possible to not have a statically indeterminate system, to the extent that neither the elastic guiding mechanism nor the wick can interfere with the locking/unlocking system. Thus, the mechanical stop of the reservoir in the active position is achieved only by the locking system and not by the wick, since the latter and the elastic guiding mechanism may move and/or deform elastically axially.

Beneficially, the curling appliance further comprises a tile articulated on the appliance to form a clamp with the mandrel, so as to move the tile between a position released from the mandrel, permitting a strand of hair to be positioned, and a position resting against the mandrel, permitting the strand of hair to be gripped in order to then perform the curling operation.

In addition, the locking/unlocking system includes a first locking element positioned on the reservoir and arranged in order to cooperate with a second locking element positioned at a distal end of the tile. These locking elements ensure that the reservoir is kept in position with respect to the tile when the tile is resting against the mandrel and the reservoir is moved to the active position. Preferably, according to this embodiment of the hair styling appliance, the first locking element and the second locking element are configured to snap into each other. However, one could envision variants of the first and second locking elements, without departing from the context of the invention. Preferably, in an embodiment, the first locking elements comprises an elastic part in the shape of a "U", equipped with a narrowing, and the second locking element comprises a pad arranged on an inner face of the tile. The narrowing keeps the elastic part engaged with the pad. Preferentially, in an embodiment, the locking/unlocking system comprises a system for returning the wick to the passive position. This ensures automatic cessation of the steam, without necessitating additional manipulation of the hair styling appliance. Preferably, the system for returning the locking/unlocking system comprise a spring, the latter being distinct from the spring of the guide system.

According to a preferential embodiment of the hair styling appliance covered by the invention, the locking/unlocking system is configured to ensure that the reservoir and the wick are kept in the active position when the tile is resting against the mandrel. This makes it possible to initiate the curling and steaming operation, only after having gripped the strand of hair. Conversely, the locking/unlocking system is configured to permit the release of the reservoir and of the wick to the passive position when the tile is in the position released from the mandrel. However, one could anticipate embodiment variants according to which the locking/unlocking system would perform the aforementioned functions of holding and release, regardless of the position of the tile with respect to the mandrel.

According to a preferential variant of the invention, the hair styling appliance comprises a unit for counting a time period, a system for detecting the active position of the wick configured to trigger the counting unit at the time of the shift to active position, and a signaling system configured to emit a signal to the user when the counting unit reaches a defined time period. Thus, the design of the hair styling appliance according to the invention makes it possible to begin counting a time period once the wick moves to the active position, which prevents the user from having to keep track of the steam application time and having to activate an additional button to initiate the count, all of these operations being initiated automatically when the user manipulates the hair styling appliance to move the wick soaked with liquid into the active position. Beneficially, the detection system comprises a detection system for detection of a temperature drop of the vaporizing plate, the temperature drop representing the beginning of the steaming step. Alternatively, the detection system comprises a switch arranged in the mandrel and a connection system for connecting the switch to the counting unit, and the hair styling appliance is configured so that the shift to the active position permits direct activation of the switch. Alternatively, the hair styling appliance comprises a body, the detection system comprising at least one rod extending inside the mandrel and a switch arranged in the body permitting the manipulation of the appliance, the body being extended by the mandrel, and the hair styling appliance is configured so that the shift to the active position permits activating the switch via the at least one rod.

Preferentially, the signaling system is configured to emit an audible signal. However, one could envision variants with a signaling system configured to emit any other type of signal identifiable by the user, such as a visual signal, for example.

BRIEF DESCRIPTION OF THE FIGURES

The following description of a preferential and non-restrictive embodiment of the hair styling appliance demonstrates the characteristics covered by this invention. This description is supported by figures, among which.

DETAILED DESCRIPTION

Figure 1:
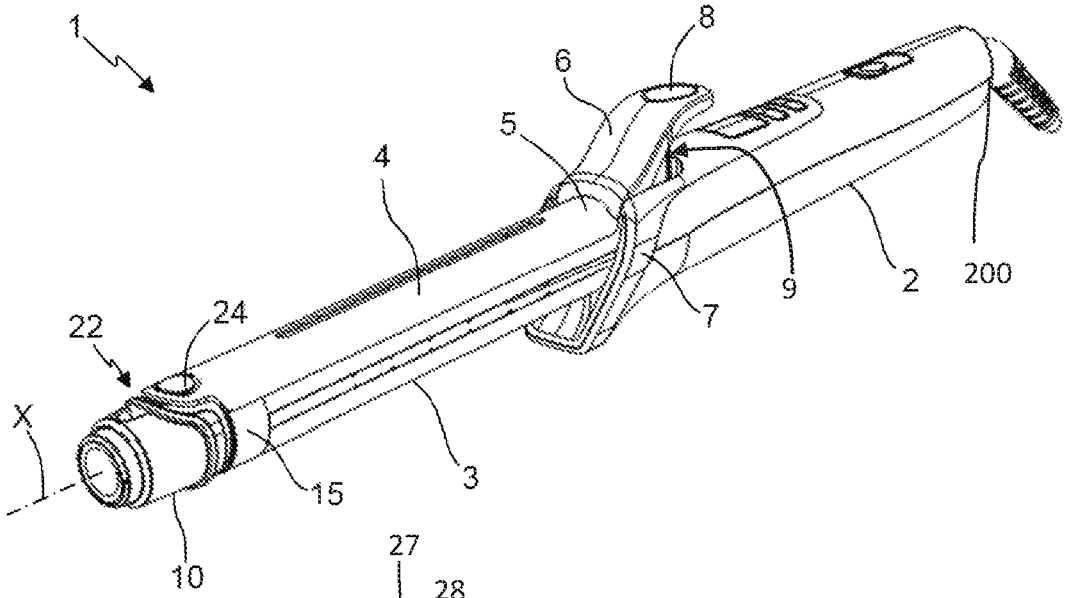
FIG. 1 illustrates a general view of a hair styling appliance as defined by an embodiment of the invention with a the resting against a mandrel.

As illustrated in FIG. 1, the hair styling appliance 1 comprises a body 2, a mandrel 3, a tile 4. The body 2 is configured to permit a user to manipulate the hair styling appliance 1 during its use. The mandrel 3 is cylindrical and extends the body 2 along a longitudinal axis X. The body 2 comprises an input 200 of a power cord, for example an electrical cord. In this description, this input 200 beneficially constitutes the point of reference in relation to which the expressions distal and proximal refer: thus, the expression "proximal end" refers to an end situated on the side of the input 200 while on the contrary, the expression "distal end" refers to an end situated opposite the input 200.

The tile 4 is in a circular shape adapted to (that is, having a shape complementary to) that of the mandrel 3. The proximal end 5 of the tile 4 is fixed to a manipulation finger 6 which is articulated with respect to the distal end 7 of the body 2. Pressure on the rear portion 8 of the manipulation finger 6 permits moving the tile 4 to a position released from the mandrel 3, in order to permit a strand of hair to be introduced between the mandrel 3 and the tile 4. A spring 9, arranged between the distal end 7 of the body 2 and the manipulation finger 6 along an axis roughly perpendicular to the axis X, permits moving the tile 4 to the position resting against the mandrel 3, as illustrated in FIG. 1, when the pressure on the manipulation finger 6 is stopped, which permits gripping a strand of hair (not illustrated) positioned between the mandrel 3 and the tile 4.

Figure 3:
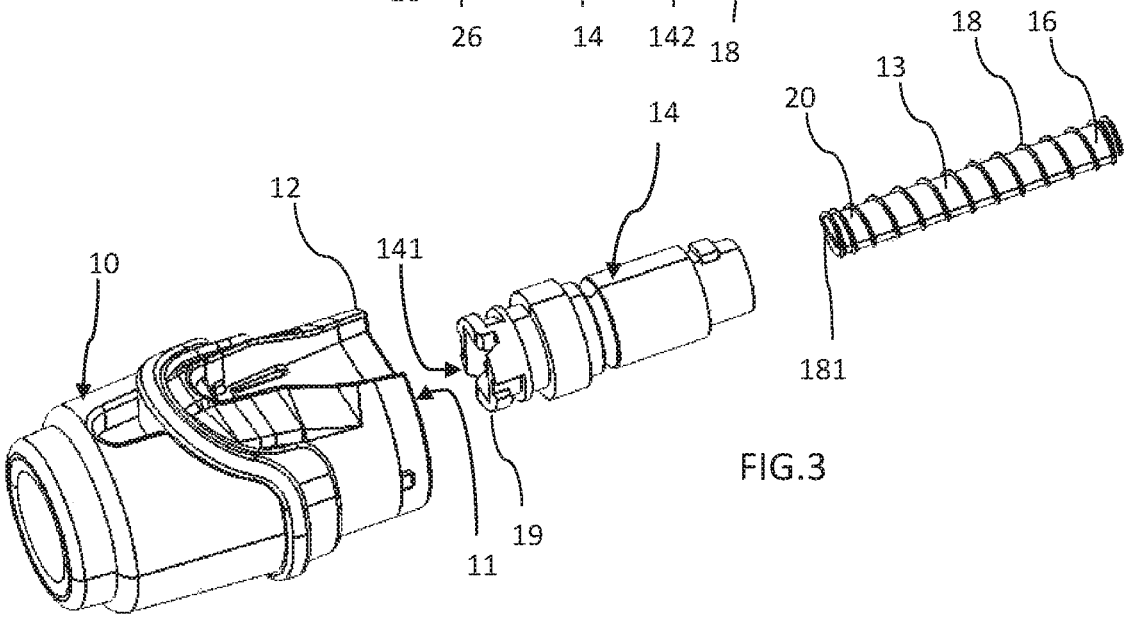
FIG. 3 illustrates an exploded perspective view of the various elements constituting the sub-assembly from FIG. 2.
Figure 8:
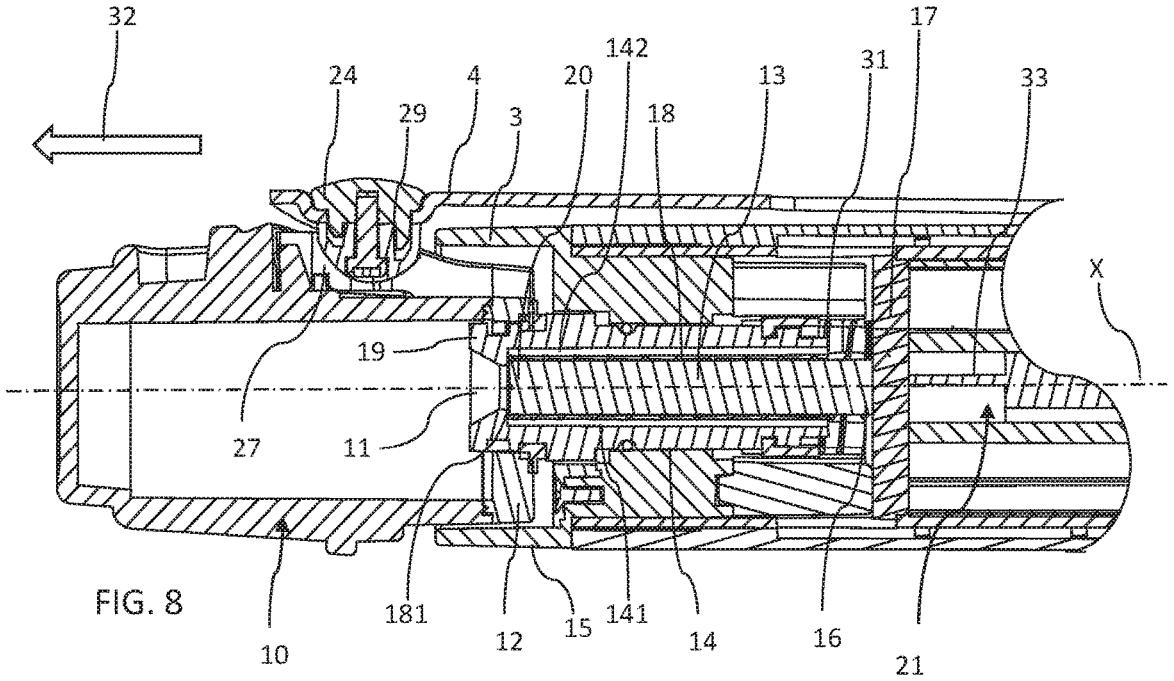
FIG. 8 is a longitudinal cross section view of the end of the appliance from FIG. 1, equipped with the sub-assembly from FIG. 2.

As illustrated in FIGS. 1 and 3 and in FIG. 8, the hair styling appliance 1 comprises a liquid reservoir 10 which comprises an opening 11 at its proximal end 12. This opening 11 permits filling the reservoir 10 with liquid. Preferentially, in an embodiment, the reservoir 10 is filled with water.

The hair styling appliance 1 further comprises a heating element 21 integrated in the mandrel 3, that is, situated inside the mandrel 3, as can be seen on FIG. 8. In particular, the heating element 21 comprises on the one hand a vaporizing plate 17 and on the other hand a heating system, such as, for example, as a positive-temperature-coefficient (PTC) thermistor, which permits heating the vaporizing plate 17 by thermal conduction. Preferentially, in an embodiment, the vaporizing plate 17 comprises a disk oriented perpendicularly to the axis X and having a diameter that roughly corresponds to the inside diameter of the mandrel 3. The heating element 21 also makes it possible to heat the mandrel 3, in a manner known as such.

The hair styling appliance 1 also comprises a wick 13 communicating with the opening 11 of the reservoir 10, which permits soaking it with liquid. More precisely, and as can be seen on the various figures, the wick 13 extends between a proximal end 16 intended to come into contact with the heating element 21, and in particular with the vaporizing plate 17, and a distal end 20 supplied with liquid by the reservoir 10, for example by being in contact with the latter and/or penetrating inside the latter. In other words, the proximal end 16 is situated on the side of the mandrel 3 while the distal end 20 is situated on the side of the reservoir 10. Preferentially, in an embodiment, the wick 13 is cylindrical in form.

Figure 2:
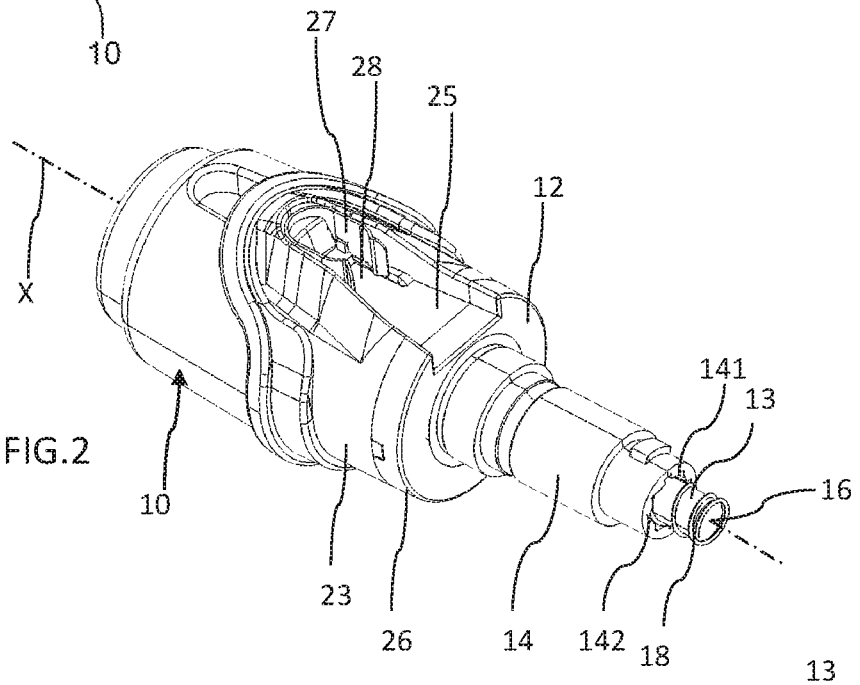
FIG. 2 illustrates a perspective view of a sub-assembly of the appliance from FIG. 1, the sub-assembly comprising a reservoir, a wick carrier, an elastic guiding mechanism and a wick.

The hair styling appliance 1 also comprises a guide system for guiding the wick 13, and notably a tubular part 14 also called a wick carrier 14, mounted in a fixed but removable manner on the reservoir 10 and intended to receive (or support or maintain) the wick 13, as can be seen on FIGS. 2, 3 and 8. More particularly, the wick carrier 14 comprises an inner bore 141 extending on the entire length of the wick carrier 14 along the axis X and intended to receive in particular the wick 13.

The guide system for guiding the wick 13 is configured to permit its movement from a passive position (position in which steam production is not permitted) to an active position (position in which steam production is permitted) in which the wick 13 is in contact with the vaporizing plate 17 in order to create steam, and vice versa.

For this purpose, the reservoir 10 and the wick carrier 14 are slidably engaged on the distal end 15 of the mandrel 3, which permits translating the elements of the wick 13 along the longitudinal axis X, with respect to the mandrel 3, in order to move the assembly (reservoir 10, wick carrier 14 and wick 13) from an active position in which the proximal end 16 of the wick 13 rests against a vaporizing plate 17, as illustrated in FIG. 8, a position permitting the creation of steam, toward a passive position in which the proximal end 16 of the wick 13 is released from the vaporizing plate 17. Preferentially, in an embodiment, when the wick 13 is in the passive position, the proximal end 16 is between 3 mm and 10 mm from the heating element 21, in particular from the vaporizing plate 17, which permits guaranteeing a total cessation of steam production. Preferentially, in an embodiment, the course separating the passive position and the active position is between 5 mm and 15 mm, and is beneficially roughly equal to 10 mm.

The guide system for guiding the wick 13 further comprises an elastic guiding mechanism, such as a spring 18, preferentially helical in an embodiment, which is in contact with the periphery of the wick 13, that is, with the outer surface of the wick 13, at the proximal end 16 of the wick 13. More precisely, as illustrated in FIGS. 3 and 8, the wick 13 is inside the spring 18 such that the cross-section of the latter is constrained by the cross-section of the spring 18. According to this preferential embodiment, the spring 18 extends between the proximal and distal ends 16, 20 of the wick 13, that is, it extends on the full length of the wick 13, thus achieving perfect guidance and maintenance of the latter. In other words, the elastic guiding mechanism, in this occurrence the spring 18, is in contact with the periphery of the wick 13 on its full length. Preferentially, in an embodiment, the length of the spring at rest is roughly equal to 30 mm, this length corresponding to the preferential length of the wick 13.

Figure 9:
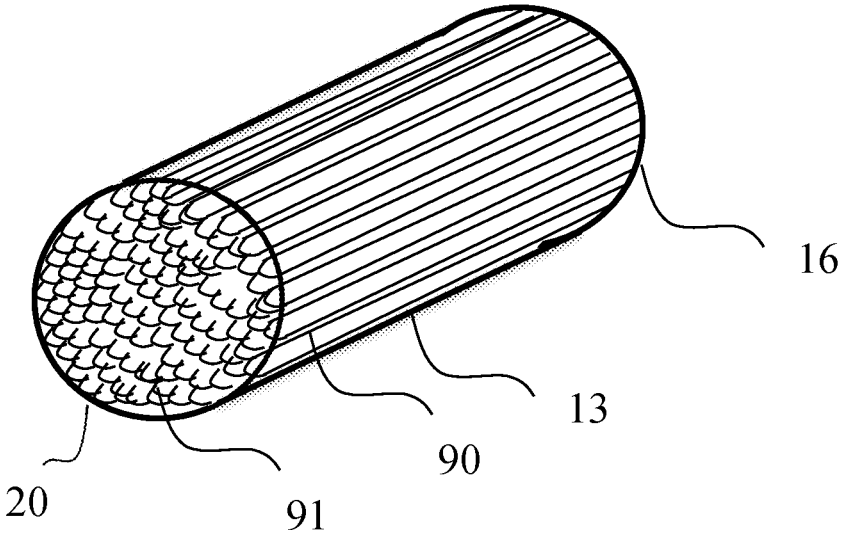
FIG. 9 is a schematic representation of a wick including a plurality of strands, with each strand being folded on itself.

FIG. 9 is a schematic representation of a wick 13 having a proximal end 16 and a distal end 20 and including a plurality of strands 90, with each strand being folded on itself at a bend 91 at the distal end 20.

According to the preferential embodiment described here, the wick 13 has a circular cross-section and the inside diameter of the spring 18, which roughly corresponds to the diameter of the wick 13, is roughly equal to 5 mm. Thus, thanks to the spring 18 which envelops the wick 13, the latter is constrained in a volume with a fixed cross-section, preventing it from compacting and/or deforming, along the radial direction, that is, along the direction perpendicular to the axis X.

On the other hand, this volume in which the wick 13 is maintained is elastically deformable along the axial direction, that is, along the direction of the axis X. In other words, this arrangement permits containing (that is, constraining) the wick 13 in a volume of a stable diameter, the diameter being roughly equal to 5 mm, regardless of the position (passive position or active position) and the condition (wet or dry) of the wick 13. In fact, even if the wick is soaked with liquid, which naturally tends to make its diameter increase, and even after numerous contacts with the vaporizing plate 17 (tending to compact it), the wick's diameter remains constant on its whole length. In addition, the dimensional characteristics of the wick 13 remain constant over time, and even after numerous uses, which makes it possible to not disturb the proper operation of the appliance, whether with regard to the production of steam by the vaporizing plate or the locking system which will be described below.

Beneficially, the wick 13 is mounted tightly inside the spring 18, and consequently immobilized inside the spring 18. Thus the disassembly of the appliance according to the sub-assemblies illustrated in FIG. 3 is facilitated and the maintenance of the appliance, and in particular the cleaning of the wick 13, is facilitated, as will be described below.

As can be seen on FIGS. 3 and 8, the spring 18 comprises a stop 181 able to come into contact with the distal end 20 of the wick 13. In particular, the stop 181 is constituted of a coil of the spring 18 which is folded so as to form a radius of the spring 18. Thus, the stop 181 resists the movement of the wick 13 situated inside the spring 18 so as to lock a degree of freedom according to an axial translation of the wick 13, and in particular according to a direction 32. Thus, the wick 13 is prevented by the stop 181 from penetrating the reservoir when the wick 13 rests on the vaporizing plate 17.

As can be seen on FIG. 8, the spring 18 as well as the wick 13 are both intended to be fitted inside the wick carrier 14 and in particular inside its inner bore 141 along the axis X, for example according to the principle of a sliding joint or a sliding pivot joint.

According to the preferential embodiment illustrated by the figures, the length of the wick carrier 14, or more precisely the length of its inner bore 141 in which is found the spring 18, is designed so that the spring is constrained (that is, compressed) by a few millimeters, preferentially, in an embodiment, between 2 mm and 5 mm, when the hair styling appliance 1 is in the active position. Consequently, and as was mentioned previously, the wick 13 is also constrained. In other words, the wick 13 and the spring 18 are both compressed by a few millimeters in the active position of the hair styling appliance 1, which permits optimizing the contact between the proximal end 16 of the wick 13 and the vaporizing plate 17, and consequently improving the steam production. Conversely, when the appliance changes to the passive position, the wick and the spring are relaxed (in their resting position). In other words, the spring 18 and the wick 13 are able to move according to a translation of axis X inside the inner bore 141 of the wick carrier 14. This compression of the wick 13 remarkably permits bestowing on the hair styling appliance 1 a pumping effect during the shift to the active position, making it possible to displace the air that may be in the wick carrier 14, and consequently to improve the effectiveness of the hair styling appliance 1. In fact, the air being quickly displaced by this pumping effect, the liquid transfer takes place more quickly between the reservoir 10 and the vaporizing plate 17, which permits producing steam more quickly, thus minimizing the user's wait time and the initiation phenomenon necessary with appliances from the prior art. In addition, the repeated translational movement of the wick 13 and of the spring 18 in the wick carrier 14 limits the formation of scale, since the latter will be eliminated with the movements of the wick 13 and the spring 18.

Such an assembly, namely the wick 13 arranged inside the spring 18, itself arranged inside the wick carrier 14, permits ensuring excellent guidance and maintenance of the wick 13 and of the reservoir 10 during axial displacement (when the user applies pressure on the reservoir 10 to obtain steam), while permitting venting of the reservoir 10. In fact, to permit the liquid contained in the reservoir 10 to flow toward the heating element by means of the wick 13, the latter should not be in negative pressure, in other words, it is desirable to ensure venting of the reservoir 10 so that the pressure does not fall inside the latter as its liquid empties.

The assembly proposed by the invention, and in particular the presence of the spring 18 between the wick 13 and the wick carrier 14, permits air to circulate along the coils of the spring 18 and consequently to circulate between the wick 13 and the wick carrier 14 to the inside of the reservoir, permitting proper transfer of the liquid by means of the wick 13. Preferentially, in an embodiment, the inner bore 14 of the wick carrier 14 comprises a channel 141 for carrying air toward the reservoir, the latter beneficially being formed of one or more grooves peripheral to the inner bore 141, along the axis X, as can be seen on FIG. 8. Thanks to the spring 19 which contains the wick 13, the grooves cannot be obstructed by the wick 13, even when the latter is soaked with liquid, thus guaranteeing proper venting of the reservoir, and consequently proper flow of the liquid it contains through the wick 13.

The assembly formed of the reservoir 10, the wick carrier 14, the wick 13 and the spring 18 is removable from the distal end 15 of the mandrel, making it possible to access the opening 11 on the reservoir 10, in order to fill it with liquid. To achieve this, the proximal end 12 of the reservoir 10 is assembled so that it is removable, including by a snap-fit connection, with the base 19 of the wick carrier 14. Thus, it is possible for the user to easily disassemble the hair styling appliance 1 according to the sub-assemblies visible in FIGS. 2 and 3. More precisely, the user may in a first step extract the sub-assembly from FIG. 2 consisting of the reservoir 10, the wick carrier 14, the wick 13 and the spring 18. Then in a second step, the user may remove the wick carrier 14 and the elements it contains (wick 13 and spring 18) from the reservoir 10 in order to access the opening 11 to easily fill the reservoir 10.

In addition, the handling and maintenance operations of the wick 13, including its descaling, for example according to a practice well known as such, consisting of plunging the latter in vinegar, are greatly facilitated by the invention, to the extent that the wick 13 is enveloped by a radially rigid body, in this occurrence the spring 18. More precisely, the user will be able to firmly grasp the spring 18 and wick 13 sub-assembly between his or her fingers, without fear of damaging the wick 13, since the latter is protected by the spring 18. In addition, the rigidity of the sub-assembly is greater, which greatly facilitates the operations of disassembly and especially reassembly of the sub-assembly in the inner bore 141 of the wick carrier 14.

Figure 4:
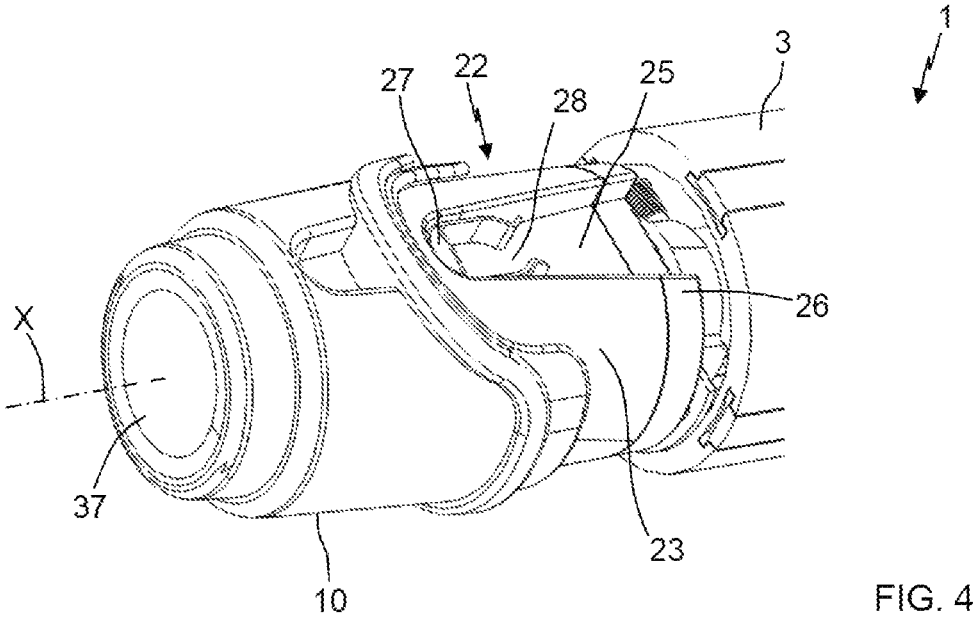
FIG. 4 illustrates a detailed perspective view of the liquid reservoir at the end of the mandrel from FIG. 1, showing a female locking element.

A locking/unlocking system 22 is arranged on the hair styling appliance 1 to keep the reservoir 10, the wick carrier 14 and the wick 13 in the aforementioned active position. As illustrated in FIGS. 1 to 5, this locking/unlocking system 22 is implemented between the perimeter wall 23 of the reservoir 10 and the distal end 24 of the tile 4. The perimeter wall 23 comprises a groove 25 opening on its proximal end 26, as illustrated in FIG. 4. This groove 25 receives an elastic part 27 in the form of a "U", the elastic part 27 comprising a narrowing 28, as illustrated in FIG. 4. This elastic part 27 constitutes a first locking element.

Figure 5:
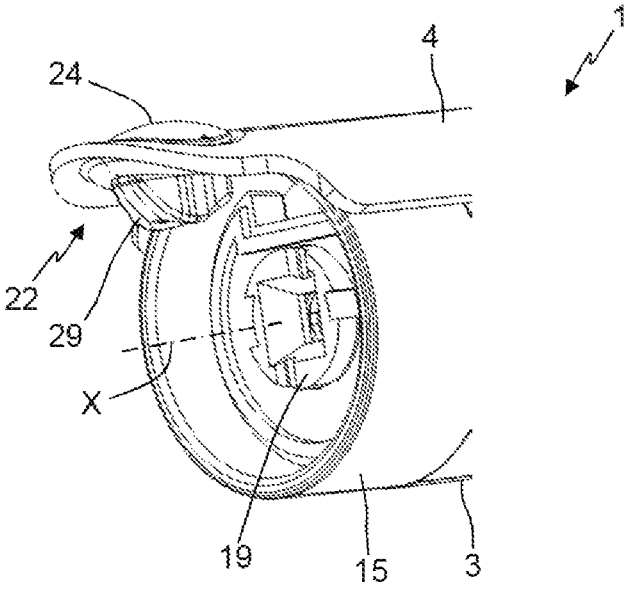
FIG. 5 illustrates a detailed perspective view of the end of the tile from FIG. 1, showing a male locking element.

As illustrated in FIG. 5, a pad 29 extends from the side of the inner face of the tile 4, at its distal end 24. The pad 29 constitutes a second locking element configured to be accommodated in the elastic part 27.

As explained previously, the spring 18 permits the wick 13 to be compressed along the axis X but without deforming radially, which remarkably permits improving the operation of the locking/unlocking system. In fact, considering the axial displacement of the spring 18 and the wick 13, the latter, once they are in contact with the vaporizing plate 17, will be able to move and/or be compressed axially, even if the movement of the reservoir 10 continues slightly along the axis X. Thus, there may not be a blocking effect due to a wick that might be too long compared to the course of the reservoir 10. Consequently, the manipulation of the hair styling appliance 1, in particular at the time it is locked into active position, is thereby facilitated for the user.

When the tile 4 rests against the mandrel 3, in the position of gripping a strand of hair, and the reservoir 10 is in a passive position, the pad 29 comes into position in the groove 25 outside of the elastic part 27. When the reservoir 10 is then moved to the active position, the elastic part 27 comes into engagement on the pad 29 according to a direction parallel to the axis X until the narrowing 28 clears the pad 29, thus permitting the elastic part 27 to be snap-fitted onto the pad 29 or vice versa, which will ensure that the reservoir 10 is kept in this active position and, consequently, ensure that the wick 13 soaked with liquid is kept against the vaporizing plate 17. The appliance thus produces steam and automatically, that is, without action by the user, remains in this position.

As illustrated in FIG. 8, a return system 31 such as a spring is arranged between the vaporizing plate 17 and the wick carrier 14, this spring making it possible to apply force on the wick carrier 14, in the direction of an arrow representing the direction 32 corresponding to the shift from the active position to the passive position. This return system for returning the locking/unlocking system is independent and distinct from the spring 18.

Snap-fitting the pad 29 in the elastic part 27 ensures that the reservoir 10 is kept in position with respect to the tile 4, in spite of this force applied by the spring 31. On the contrary, when the user moves the tile 4 to the position released with respect to the mandrel 3, the pad 29 is released from the elastic part 27 according to a movement roughly perpendicular to the axis X, which permits the spring 31 to push the wick carrier 14 and the reservoir 10 (and the wick 13) back to the passive position, ceasing the production of steam. Thus, when the user lifts the tile 4 to extract the strand of hair, this has the immediate effect of automatically shifting the wick 13 to the passive position, and consequently ceasing the production of steam.

Figure 6:
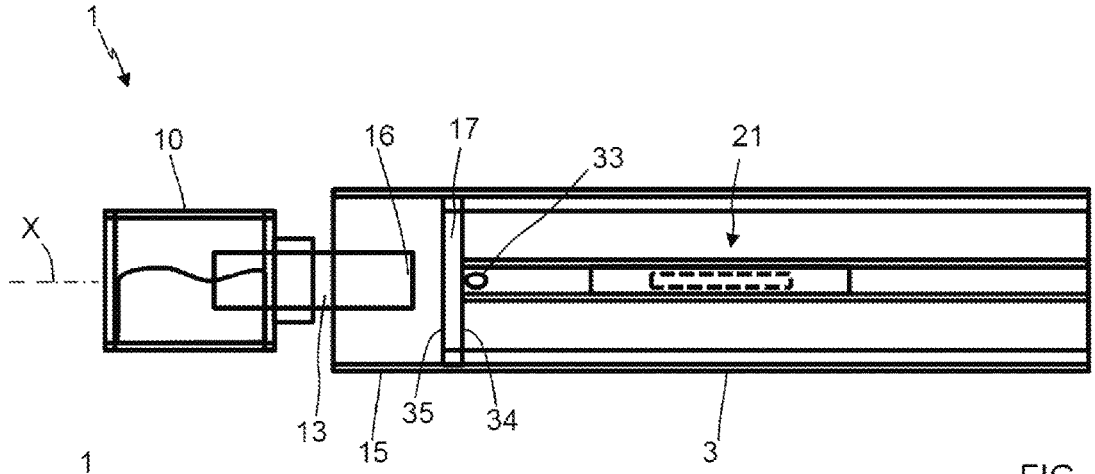
FIGS. 6 and 7 diagram two variants of a system for detection of the active position of the wick.

Beneficially, the hair styling appliance 1 comprises a system for detection of the active position of the reservoir 10, of the wick carrier 14 and of the wick 13, in which steam is generated. This detection system comprises, for example, a system 33 for detection of a temperature drop in the vaporizing plate 17, the detection system 33 itself comprising a temperature sensor, preferably, in an embodiment, a positive-temperature-coefficient (PTC) thermistor. This temperature sensor is positioned in contact with the inner face 34 of the vaporizing plate 17 (that is, the face not in contact with the wick 13), as diagrammed in FIG. 6. When the proximal end 16 of the wick 13 comes into contact with the outer face 35 of the vaporizing plate 17, the vaporizing plate 17 undergoes a sudden decrease in temperature, which is detected by the temperature sensor. The temperature sensor transmits the information on the temperature decrease to an electronic control box integrating a counting unit which counts a time period, for example, of ten seconds, during which the steam creation and heating of the mandrel 3 should be maintained once the strand of hair is rolled around the mandrel 3. This time period may be adjusted by the user according to indexed steam exposure time values, for example 5, 8 or 10 seconds, this adjustment being accessible from a user interface on the hair styling appliance 1. Once the time period has elapsed, the counting unit transmits the information to the electronic control box, which triggers an audible signal, such as a beep, or a luminous signal, instructing the user to release the tile 4 from the mandrel 3, in order to release the reservoir 10 and the wick 13 to the passive position, and thus to cease the creation of steam, before removing the curled strand of hair.

Figure 7:
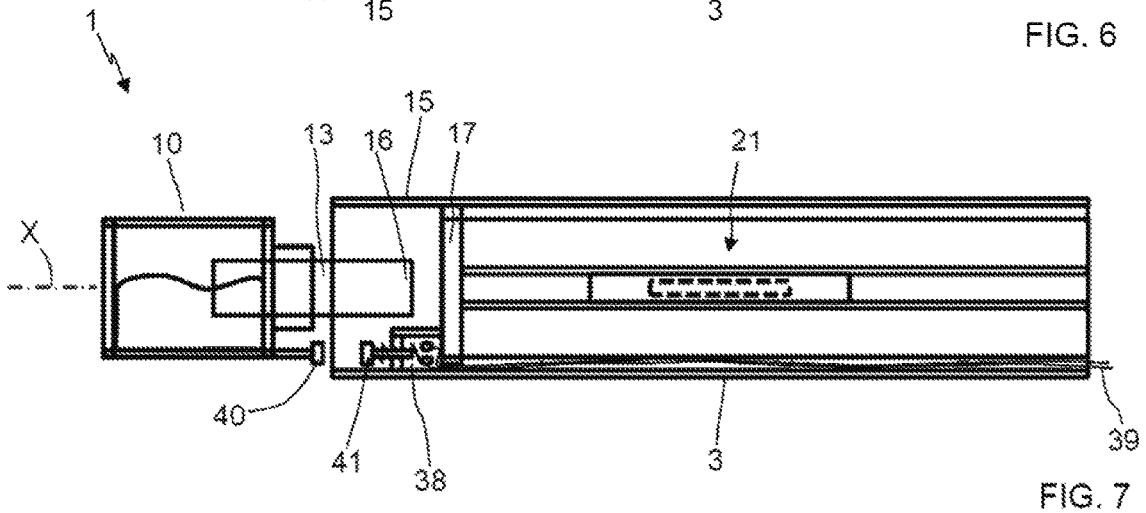

FIG. 7 diagrams a second variant of embodiment of a system for detection of the active position of the reservoir 10, of the wick carrier 14 and of the wick 13 in contact with the vaporizing plate. According to this variant, the detection system comprises a switch 38 arranged at the distal end 15 inside the mandrel 3. This switch 38 is connected by a connection system 39 such as a cable to the electronic control box which integrates the counting unit and which is housed in the body 2 of the hair styling appliance 1, the cable crossing the full length of the mandrel 3. A portion 40 of the reservoir 10 is configured to activate a pushbutton 41 of the switch 38 when the reservoir 10, the wick carrier 14 and the wick 13 move to the active position, the switch then triggering the counting unit (not illustrated) situated in the electronic control box.

The preceding description captures the essence of the invention, without limiting its scope. Thus, other variants may be envisioned, in particular as to the implementation and arrangement of the elastic guiding mechanism or the constitution of the wick itself.

Other characteristics may be envisioned without departing from the context of the invention. For example, one could anticipate a lid (not illustrated) making it possible to open the distal end 37 of the reservoir 10 in order to fill it with liquid without having to disassemble the reservoir 10 from the distal end 15 of the mandrel 3.

The invention claimed is:

1. A hair styling appliance for curling hair comprising a mandrel, a liquid reservoir, a heating element integrated in the mandrel, a wick communicating with the reservoir such that the wick is soaked with liquid, said wick extending between a proximal end intended to come into contact with the heating element and a distal end supplied with liquid from the reservoir, and a guide system configured to guide the wick that is configured to permit the wick to move from a passive position to an active position in which said wick is in contact with the heating element in order to create steam, wherein the guide system comprises an elastic guiding mechanism in direct contact with a peripheral surface of said wick at the proximal end in said passive position and said active position, and wherein the wick extends inside the elastic guiding mechanism such that a cross-section of the wick is constrained by a cross-section of the elastic guiding mechanism, wherein the elastic guiding mechanism comprises a helical spring and wherein the wick is arranged inside the spring such that the helical spring is in direct contact with the peripheral surface of the wick.

2. The hair styling appliance according to claim 1, wherein the elastic guiding mechanism is permeable to air.

3. The hair styling appliance according to claim 1, wherein the diameter of the spring is between 2 mm and 8 mm.

4. The hair styling appliance according to claim 3, wherein the diameter of the spring is between 4 mm and 6 mm.

5. The hair styling appliance according to claim 1, wherein the length of the spring at rest is between 15 mm and 45 mm.

6. The hair styling appliance according to claim 5, wherein the length of the spring at rest is between 25 mm and 35 mm.

7. The hair styling appliance according to claim 1, wherein the guide system comprises a wick carrier inside of which is said helical spring.

8. The hair styling appliance according to claim 7, wherein the wick carrier comprises a channel for carrying air toward the reservoir.

9. The hair styling appliance according to claim 1, wherein the elastic guiding mechanism extends from said proximal end to said distal end of the wick.

10. The hair styling appliance according to claim 9, wherein the elastic guiding mechanism comprises a stop able to come into contact with said distal end.

11. The hair styling appliance according to claim 9, wherein the elastic guiding mechanism is in direct contact with the peripheral surface of the wick from said proximal end to said distal end of the wick.

12. The hair styling appliance according to claim 1, wherein the wick comprises a plurality of strands in contact with each other, said strands extending longitudinally.

13. The hair styling appliance according to claim 12, wherein each strand is a fiberglass strand.

14. The hair styling appliance according to claim 12, wherein a length of each strand is between 30 mm and 90 mm, each of said strands being folded on itself so as to divide its length in two.

15. The hair styling appliance according to claim 14, wherein a length of each strand is between 50 mm and 70 mm.

16. The hair styling appliance according to claim 14, wherein a bend of the strands forms the distal end while a free end of the strands forms the proximal end.

17. The Hair styling appliance according to claim 1, wherein the wick is integral with the reservoir, the guide system being configured to move the reservoir and the wick from the passive position to the active position.

18. The hair styling appliance according to claim 17, further comprising a locking/unlocking system configured to ensure that the reservoir and the wick are kept in the active position.

19. The hair styling appliance according to claim 1, wherein the elastic guiding mechanism envelops the wick from said proximal end to said distal end of the wick so that the wick is constrained in a volume with a fixed cross-section and a diameter of the wick remains constant when the wick is in contact or out of contact with the heating element.

* * * * *